US008454459B1

(12) United States Patent
Reed

(10) Patent No.: US 8,454,459 B1
(45) Date of Patent: Jun. 4, 2013

(54) PITCHING GAME SYSTEM AND ASSOCIATED METHOD

(76) Inventor: Kathy Reed, Prospect, CT (US)

( * ) Notice: Subject to any disclaimer, the term of this patent is extended or adjusted under 35 U.S.C. 154(b) by 155 days.

(21) Appl. No.: 12/952,649

(22) Filed: Nov. 23, 2010

(51) Int. Cl.
*A63B 63/00* (2006.01)

(52) U.S. Cl.
USPC ..... 473/476; 273/343

(58) Field of Classification Search
USPC ..... 473/180, 476, 514; 273/118 R, 127 B, 273/336, 343, 348.4, 386, 402; 40/598; 434/188; 446/48; D21/302, 790
See application file for complete search history.

(56) References Cited

U.S. PATENT DOCUMENTS

| | | | | | |
|---|---|---|---|---|---|
| 1,280,082 | A | * | 9/1918 | Pierson | 273/317.5 |
| 1,587,295 | A | * | 6/1926 | Gammeter | 473/172 |
| 1,715,365 | A | * | 6/1929 | Hoffman et al. | 473/180 |
| 3,147,734 | A | * | 9/1964 | Knapp | 116/63 R |
| D249,078 | S | * | 8/1978 | Gutke | D21/302 |
| 4,487,419 | A | * | 12/1984 | Welbourn | 273/343 |
| 4,637,616 | A | | 1/1987 | Whiting | |
| 4,906,006 | A | * | 3/1990 | Sigunick | 473/185 |
| 4,986,549 | A | | 1/1991 | Kuhtic et al. | |
| 5,123,656 | A | | 6/1992 | Green | |
| 5,324,042 | A | | 6/1994 | Demas | |
| 5,465,962 | A | * | 11/1995 | Hiserman | 273/118 R |
| 5,665,017 | A | * | 9/1997 | Walters | 473/573 |
| 5,669,833 | A | * | 9/1997 | Stone | 473/422 |
| 6,241,621 | B1 | * | 6/2001 | Maher | 473/185 |
| 6,773,015 | B2 | | 8/2004 | Long et al. | |
| 7,198,273 | B1 | * | 4/2007 | Advocate | 273/343 |
| 2008/0015058 | A1 | | 1/2008 | Noble et al. | |
| 2008/0042359 | A1 | | 2/2008 | Bolton | |

OTHER PUBLICATIONS

Webpage download, ACA, 2003, www.playcornhole.org/index.php, 5 pages.*
Webpage download, Bigbirdiegolf, 2009, www.bigbirdiegolf.com/, 5 pages.*

* cited by examiner

*Primary Examiner* — Gene Kim
*Assistant Examiner* — M Chambers

(57) ABSTRACT

A pitching game system may include a multi-direction course having a plurality of tossing sections juxtaposed side-by-side and a plurality of flexible projectiles. A plurality of targets may be placed at an ending point of each of the tossing sections. Each of the targets has a numerical point value imprinted on its top surface. The targets may further be positioned at the ending point of each of the tossing sections respectively. A plurality of marker cones spaced from the targets may be positioned at a starting point of each of the tossing sections. Such marker cones may designate a standing location of the player at each of the tossing sections respectively. The player may throw the projectiles along a trajectory having a linear distance of at least fifty feet beginning from a corresponding one of the marker cones and ending at a corresponding group of the targets respectively.

11 Claims, 4 Drawing Sheets

PITCHING GAME SYSTEM AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to outdoor throwing games and, more particularly, to a pitching game system and associated method for providing users with a fun and exciting game in which users throw projectiles at a target to score points.

2. Prior Art

For many Americans the spring and summer months are designated for being outdoors with friends and family at picnics, barbecues or family reunions. At many family reunions you will find people participating in many types of games such as horseshoes, Frisbee, softball or even flag football. These games are fun and encourage spirited competition. Traditional sports activities typically require a high level of physical involvement in less than safe environments. A result is that those with physical limitations are largely excluded. In addition, since each sport generally is directed towards people of a particular age group, no one sports activity appears to have a common element for people of all ages.

Accordingly, a need remains for a system in order to overcome the above-noted shortcomings. The present invention satisfies such a need by providing a pitching game system that is convenient and easy to use, lightweight yet durable in design, versatile in its applications, and designed for providing a user with an enjoyable game that can be played by users of all physical varieties at the same time.

BRIEF SUMMARY OF THE INVENTION

In view of the foregoing background, it is therefore an object of the present invention to provide a system for providing player enjoyment. These and other objects, features, and advantages of the invention are provided by a pitching game system.

The pitching game system may include a multi-direction course having a plurality of tossing sections juxtaposed side-by-side in a non-overlapping pattern and a plurality of flexible projectiles capable of being thrown by a player along each of the tossing sections. A plurality of targets capable of being positioned on a ground surface may be placed at an ending point of each of the tossing sections such that a top surface of each the targets lays substantially parallel to the ground surface. Each of the targets preferably has a numerical point value imprinted on the top surface thereof. The targets may further be positioned at the ending point of each of the tossing sections respectively.

A plurality of marker cones spaced from the targets may be positioned at a starting point of each of the tossing sections. Such marker cones may designate a standing location of the player at each of the tossing sections respectively. The player may throw the projectiles along a trajectory beginning from a corresponding one of the marker cones and ending at a corresponding group of the targets respectively. The trajectory preferably has a linear distance of at least fifty feet measured between the corresponding marker cones and the corresponding targets of each of the tossing sections respectively. The starting and ending points of each of the tossing section may be oppositely aligned along the multi-direction course. Such an arrangement provides the unexpected and unpredictable advantage of playing a game that requires accuracy, co-ordination and some basic athletic ability but does not require speed, strength, stamina and agility so that anyone regardless of age can play against each other.

The projectiles may include a rope preferably having opposed proximal and distal ends and first and second anchor members removably attached to the proximal and distal ends of the rope respectively. The first anchor member may be larger and heavier than the second anchor member. The first anchor member has a pear shape with a center of mass located towards an outermost end of the first anchor member and away from the proximal end of the rope. Such an arrangement provides the unexpected and unpredictable advantage of enabling the flight path of the projectiles to form a trajectory that provides the maximum distance possible when thrown by a player.

Each of the targets may include a tarp provided with a unique diameter and a bottom surface adapted to be placed on a ground surface. A plurality of grommets may be connected to a circumferential edge of each of the targets and a plurality of fasteners removably inserted through the grommets and thereby independently anchoring the targets to the ground surface. Such an arrangement provides the unexpected and unpredictable advantage of ensuring a flat surface for the projectiles to land on without excessive bounce as well as allow the ground to absorb the impact of the projectiles on the target.

The targets may be concentrically stacked on each other with a smallest one of the targets disposed on top of remaining ones of the targets or be juxtaposed adjacent to each other and arranged in a non-overlapping configuration. Such an arrangement provides the unexpected and unpredictable advantage of alternative target arrangements for testing the accuracy of the player.

The disclosure may include a method of playing a pitching game system for providing player enjoyment. Such a method may include the chronological steps of: providing a multi-direction course including a plurality of tossing sections; juxtaposing the tossing sections side-by-side in a non-overlapping pattern such that starting and ending points of each of the tossing sections are oppositely aligned along the multi-direction course; providing and positioning a plurality of flexible projectiles at a starting point of a first one of the tossing sections; providing and positioning a plurality of targets on a ground surface at the ending point of each of the tossing sections such that a top surface of each of the targets lays substantially parallel to a ground surface, each of the targets preferably having a numerical point value imprinted on the top surface thereof and positioned at the ending point of each of the tossing sections respectively.

The method may further include the steps of: designating a player standing location at each of the tossing sections respectively by providing and positioning the marker cones at the starting point of each of the tossing sections such that the marker cones are spaced from the targets respectively; and the player continuously throwing the projectiles along a trajectory beginning from the starting point of the first tossing section and ending at the ending point of a last one of the tossing sections respectively; wherein the trajectory has a linear distance of at least fifty feet measured between the corresponding marker cones and the corresponding targets of each of the tossing sections respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
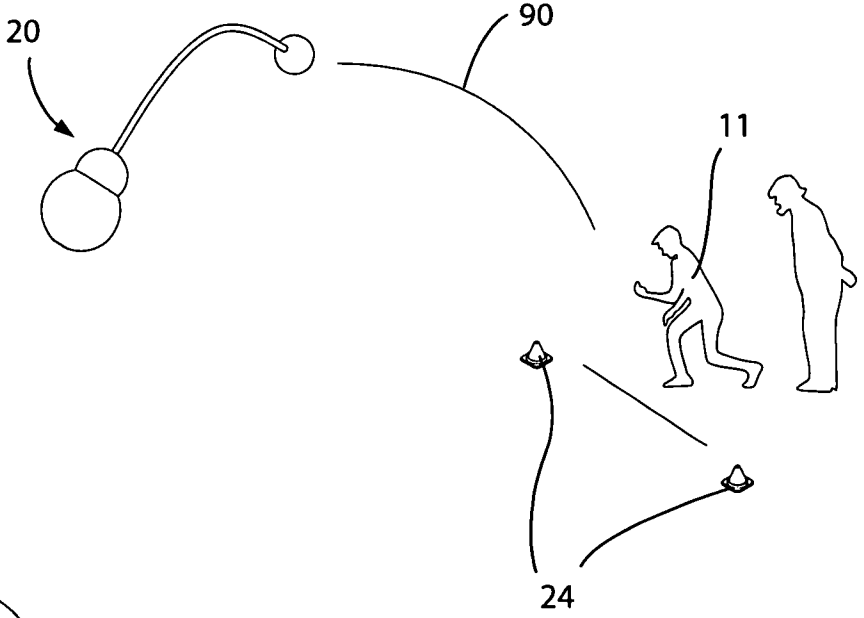
FIG. 1 is a perspective view showing a projectile pitching game system, in accordance with the present invention.
Figure 1:
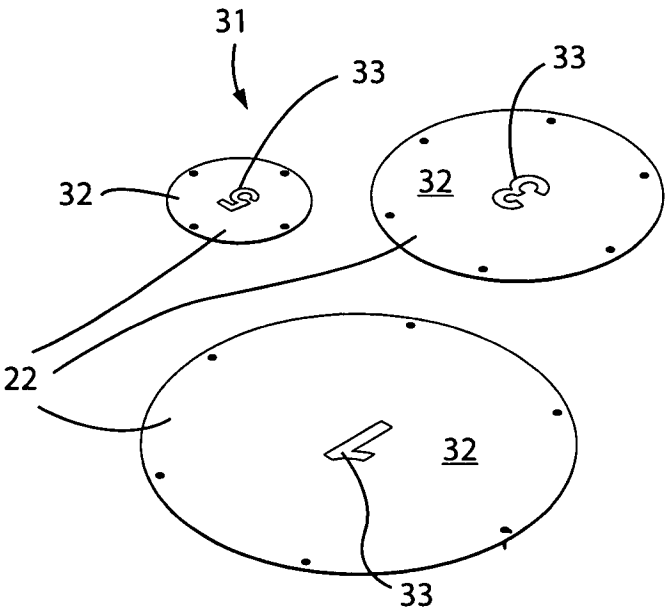
Figure 2:
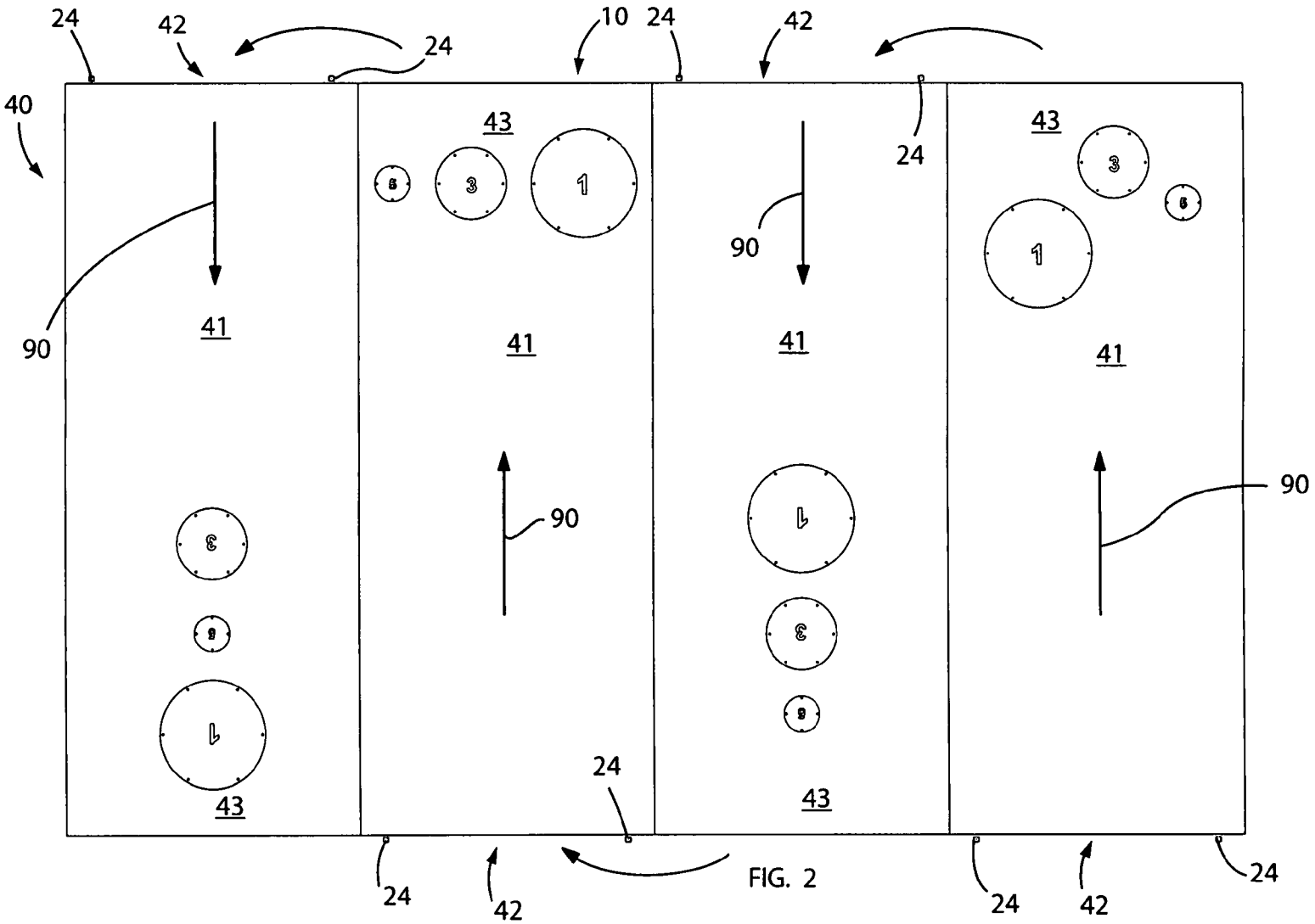
FIG. 2 is a top plan view of the projectile pitching system showing the multi-directional course and the targets arranged in a non-overlapping configuration.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of system and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The system of this invention is referred to generally in FIGS. 1-7 and is intended to provide a projectile pitching game system. It should be understood that the present invention may be used to provide a fun, physical game that can be played by a variety of players preferably in outdoor environments.

Referring to FIGS. 1-7, the pitching game system 10 may include a multi-direction course 40 (as perhaps best shown in FIG. 2) having a plurality of tossing sections 41 juxtaposed side-by-side in a non-overlapping pattern. A plurality of flexible projectiles 20 (as perhaps best shown in FIGS. 3 and 4)

are thrown by a player 11 along each tossing section 41. A plurality of targets 31 are positioned on a ground surface and thereby placed at an ending point of each of the tossing sections 41 such that a top surface 32 of each target 31 lays substantially parallel to the ground surface. Each of the targets 31 preferably has a numerical point value 33 imprinted on the top surface 32 thereof. The targets 31 may further be positioned at the ending point of each tossing section 41 respectively.

A plurality of marker cones 24 are spaced from the targets 31 and may be positioned at a starting point 42 of each tossing section 41. Such marker cones 24 may designate a standing location of the player 11 at each tossing section 41 respectively. The player 11 may throw the projectiles 20 along a trajectory 90 beginning from a corresponding one of the marker cones 24 and ending at a corresponding group of the targets 31 respectively. The trajectory 90 preferably has a linear distance of at least fifty feet measured between the corresponding marker cones 24 and the corresponding targets 31 of each of the tossing sections 41 respectively. The starting and ending points of each of the tossing section may be oppositely aligned along the multi-direction course 40. Such an arrangement provides the unexpected and unpredictable advantage of playing a game that requires accuracy, coordination and some basic athletic ability but does not require speed, strength, stamina and agility so that a variety of different aged players can play against each other.

Figure 4:
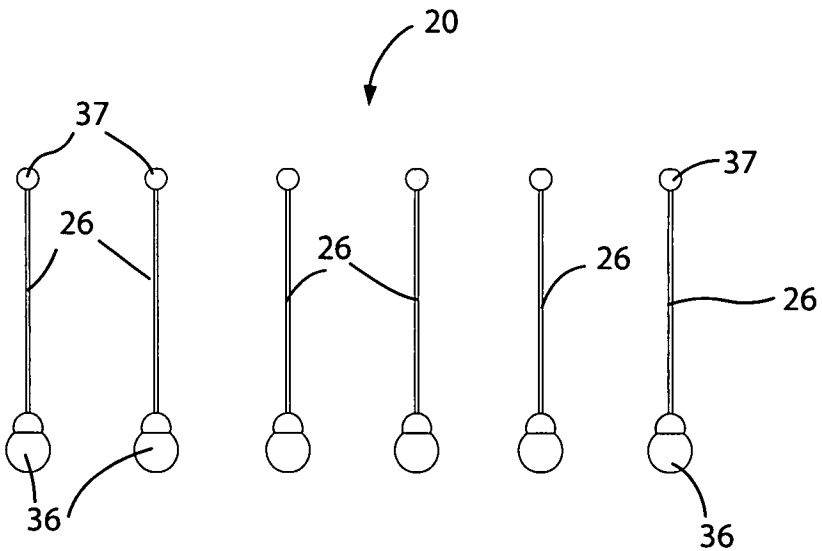
FIG. 4 is a top plan view showing an exemplary set of projectiles.
Figure 3:
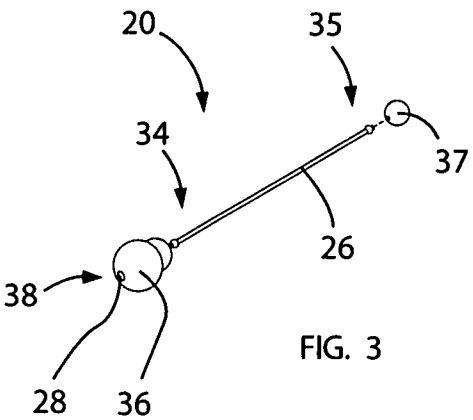
FIG. 3 is an exploded view of a projectile showing the first and second anchor members detached from the rope.

Referring to FIGS. 3 and 4, the projectiles 20 may include a rope 26 preferably having opposed proximal and distal ends 34, 35 and first and second anchor members 36, 37 removably attached to the proximal and distal ends 34, 35 of the rope 26 respectively. The first anchor member 36 may be larger and heavier than the second anchor member 37. Such a structural configuration enables the players to maintain the projectile 20 along a desired travel path.

As a non-limiting example, the first anchor member preferably has a pear shape with a center of mass located towards an outermost end 38 of the first anchor member 36 and away from the proximal end 34 of the rope 26. Such a structural configuration provides the unexpected and unpredictable advantage of enabling the flight path of the projectiles 20 to form a trajectory 90 that remains aligned within each tossing section 41.

Figure 5:
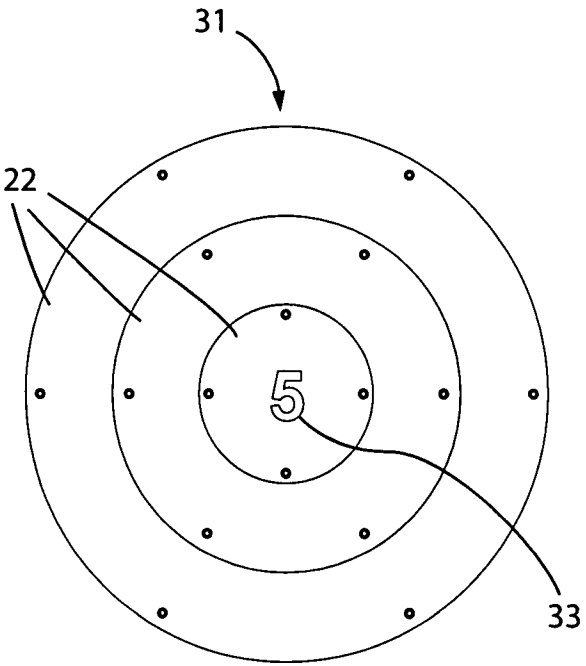
FIG. 5 is a top plan view showing the targets arranged in an exemplary concentric configuration with a smallest one of the targets disposed on top of remaining ones of the targets.
Figure 6:
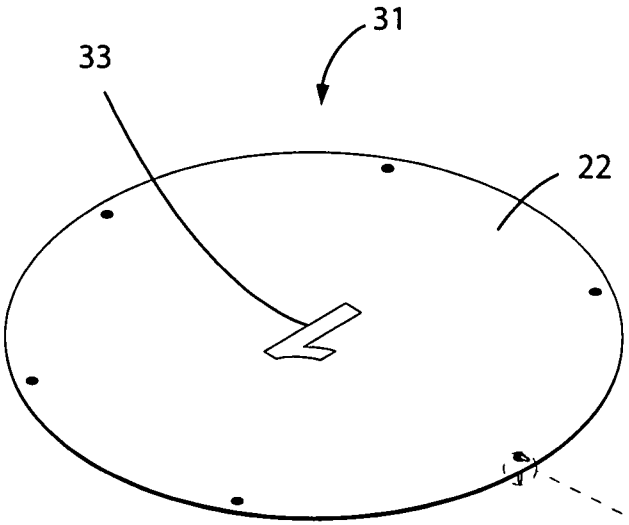
FIG. 6 is a perspective view showing an exemplary target with grommets and fasteners.
Figure 7:
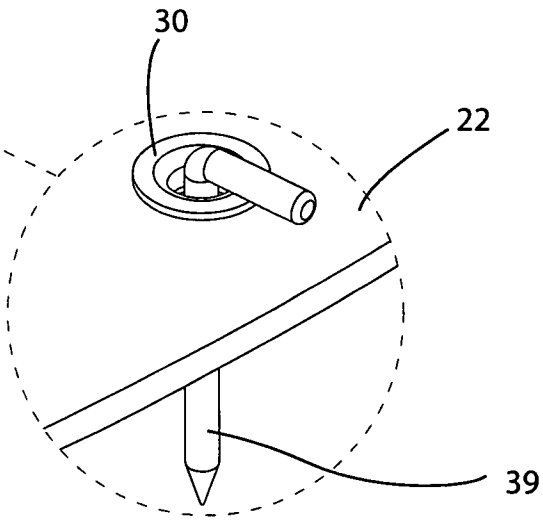
FIG. 7 is an enlarged partial view of an exemplary grommet and fastener shown in FIG. 6.

Referring to FIGS. 5-7, each target 31 may include a tarp 22 provided with a unique diameter and a bottom surface adapted to be placed on a ground surface. As perhaps best shown in FIG. 7, a plurality of grommets 30 may be connected to a circumferential edge of each of the targets 31 and a plurality of fasteners 39 may be removably inserted through the grommets 30 thereby independently anchoring the targets 31 to the ground surface. Such an arrangement provides the unexpected and unpredictable advantage of ensuring the targets 31 provide a clear landing zone for the projectiles 20 to land on as well as allow the ground to absorb the impact of the projectiles 20 on the targets 31.

As shown in FIG. 5 and FIG. 1 respectively, the targets 31 may be concentrically stacked on each other with a smallest one of the targets 31 disposed on top of remaining ones of the targets 31 or juxtaposed adjacent to each other and arranged in a non-overlapping configuration, for example. Such alternate arrangements provide the unexpected and unpredictable advantage of manipulating target locations for players 11 with various skill levels.

The present disclosure may further include a method of playing a projectile pitching game system 10 for providing player enjoyment. Such a method may include the chronological steps of: providing a multi-direction course 40 including a plurality of tossing sections 41; juxtaposing the tossing sections 41 side-by-side in a non-overlapping pattern such that starting and ending points of each tossing section 41 is oppositely aligned along the multi-direction course 40; providing and positioning a plurality of flexible projectiles 20 at a starting point 42 of a first one of the tossing sections 41; and providing and positioning a plurality of targets 31 on a ground surface at the ending point 43 of each tossing section 41 such that a top surface 32 of each target 31 lays substantially parallel to a ground surface. As a non-limiting example, each target 31 preferably has a numerical point value 33 imprinted on the top surface 32 thereof and positioned at the ending point of each tossing section 41 respectively.

The method may further include the chronological steps of: designating a player 11 standing location at each tossing section 41 respectively by providing and positioning the marker cones 24 at the starting point of each tossing section 41 such that the marker cones 24 are spaced from the targets 31 respectively; and the player 11 continuously throwing the projectiles 20 along a trajectory 90 beginning from the starting point of the first tossing section and ending at the ending point of a last one of the tossing sections 41 respectively. In this manner, the trajectory 90 has a linear distance of at least fifty feet measured between the corresponding marker cones 24 and the corresponding targets 31 of each tossing section 41 respectively.

As a non-limiting example, the projectiles 20 may be manufactured of a heavy-duty rubber material or other suitably durable and bouncy material well known in the industry. The projectiles 20 may be divided into two sets of three like-colored projectiles 20. The projectiles 20 may be shaped like a pear and measure approximately 3½ inches from top to bottom. The rope 26 may measure approximately 18 inches. The inside of the projectiles 20 may be hollow and an opening 28 may be formed in the bottom of the projectile for receiving one knotted end of rope 26, as perhaps best shown in FIG. 3.

As a non-limiting example, the tarps 22 may be circular targets 31 ranging in 9 feet in diameter for the largest tarp, 6 feet in diameter for the medium sized tarp and 3 feet in diameter for the smallest tarp. Tarps 22 may be manufactured of canvas or other suitably durable yet foldable material well known in the industry. Notably, the components of the system 10 may be stored and transported in a provided tote bag.

As a non-limiting example, the pitching game system 10 would be simple and straightforward to use. The player may set up the tarps 22 either outdoors or in a large gymnasium. As a non-limiting example, the tarps 22 may be spaced out 75 to 100 feet away from the participants. The projectiles 20 would be divided among the players with three like-colored projectiles 20 going to one player or team and the remaining like-colored projectiles 20 going to the other player or team. Standing behind the cones 24 and grasping the projectile 20 by the rope 26, the player 11 swings the projectile 20, in an underarm motion, launching it toward the tarps 22. The tarps 22 may be awarded different point values based on their size. Points may be awarded only when the projectile 20 hits a tarp 22 on the fly. Hitting the largest tarp would earn the player 1 point, 3 points for the middle sized tarp and 5 points for the smallest tarp. Projectiles 20 that bounce onto a tarp 22 do not count.

In an alternative embodiment, the system 10 may feature tarps 22 and projectiles 20 that glow in the dark. With this embodiment, the game could be played at night. Logos may also be displayed on the tarps 22 so that users can show off their team spirit.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A pitching game system for providing player enjoyment, said pitching game system comprising:

a plurality of flexible projectiles capable of being thrown by a player;

a plurality of targets capable of being positioned on a ground surface such that a top surface of each said targets lays substantially parallel to the ground surface, each of said targets having a numerical point value imprinted on said top surface thereof; and at least one marker cone spaced from said targets, said at least one marker cone designating a standing location of the player;

wherein the player throws said projectiles along a trajectory beginning from said at least one marker cone and ending at said targets;

wherein said trajectory has a linear distance of at least fifty feet measured between said at least one marker cone and at least one of said targets;

wherein each of said projectiles comprises a rope having opposed proximal and distal ends; and first and second anchor members removably attached to said proximal and distal ends of said rope respectively;

wherein said first anchor member is larger and heavier than said second anchor member;

wherein said first anchor member has a pear shape having a smaller rounded top portion proximate said rope and a larger rounded bottom portion with a center of mass located towards an outermost end of said first anchor member and away from said proximal end of said rope.

2. The pitching game system of claim 1, wherein each of said targets comprises: a tarp provided with a unique diameter and a bottom surface adapted to be placed on a ground surface.

3. The pitching game system of claim 1, further comprising:

a plurality of grommets connected to a circumferential edge of each of said targets; and a plurality of fasteners removably inserted through said grommets and thereby independently anchoring said targets to the ground surface.

4. The pitching game system of claim 1, wherein said targets are concentrically stacked on each other with a smallest one of said targets being disposed on top of remaining ones of said targets.

5. The pitching game system of claim 1, wherein said targets are juxtaposed adjacent to each other and arranged in a non-overlapping configuration.

6. A pitching game system for providing player enjoyment, said pitching game system comprising:

a multi-direction course including a plurality of tossing sections juxtaposed side-by-side in a non-overlapping pattern;

a plurality of flexible projectiles capable of being thrown by a player along each of said tossing sections;

a plurality of targets capable of being positioned on a ground surface at an ending point of each of said tossing sections such that a top surface of each said targets lays substantially parallel to the ground surface, each of said targets having a numerical point value imprinted on said top surface thereof and positioned at said ending point of each of said tossing sections respectively; and a plurality of marker cones spaced from said targets and positioned at a starting point of each of said tossing sections, said marker cones designating a standing location of the player at each of said tossing sections respectively;

wherein the player throws said projectiles along a trajectory beginning from a corresponding one of said marker cones and ending at a corresponding group of said targets respectively;

wherein said trajectory has a linear distance of at least fifty feet measured between said corresponding marker cones and said corresponding targets of each of said tossing sections respectively;

wherein said starting and ending points of each said tossing section are oppositely aligned along said multi-direction course;

wherein each of said projectiles comprises:

a rope having opposed proximal and distal ends; and first and second anchor members removably attached to said proximal and distal ends of said rope respectively;

wherein said first anchor member is larger and heavier than said second anchor member;

wherein said first anchor member has a pear shape having a smaller rounded top portion proximate said rope and a larger rounded bottom portion with a center of mass located towards an outermost end of said first anchor member and away from said proximal end of said rope.

7. The pitching game system of claim 6, wherein each of said targets comprises: a tarp provided with a unique diameter and a bottom surface adapted to be placed on a ground surface.

8. The pitching game system of claim 6, further comprising:

a plurality of grommets connected to a circumferential edge of each of said targets; and a plurality of fasteners removably inserted through said grommets and thereby independently anchoring said targets to the ground surface.

9. The pitching game system of claim 6, wherein said targets are concentrically stacked on each other with a smallest one of said targets being disposed on top of remaining ones of said targets.

10. The pitching game system of claim 6, wherein said targets are juxtaposed adjacent to each other and arranged in a non-overlapping configuration.

11. A method of playing a pitching game system utilizing the device of claim 1 or claim 10 for providing player enjoyment, said method comprising the chronological steps of:

providing a multi-direction course including a plurality of tossing sections;

juxtaposing said tossing sections side-by-side in a non-overlapping pattern such that starting and ending points of each of said tossing sections are oppositely aligned along said multi-direction course;

providing and positioning a plurality of flexible projectiles at a starting point of a first one of said tossing sections;

providing and positioning a plurality of targets on a ground surface at said ending point of each of said tossing sections such that a top surface of each of said targets lays substantially parallel to a ground surface, each of said targets having a numerical point value imprinted on said top surface thereof and positioned at said ending point of each of said tossing sections respectively;

designating a player standing location at each of said tossing sections respectively by providing and positioning said marker cones at the starting point of each of said tossing sections such that said marker cones are spaced from said targets respectively; and the player continuously throwing said projectiles along a trajectory beginning from the starting point of said first tossing section and ending at said ending point of a last one of said tossing sections respectively;

wherein said trajectory has a linear distance of at least fifty feet measured between said corresponding marker cones and said corresponding targets of each of said tossing sections respectively.

* * * * *